US006284109B1

(12) United States Patent
Ebert

(10) Patent No.: US 6,284,109 B1
(45) Date of Patent: Sep. 4, 2001

(54) SPACER MECHANISM FOR ANODES

(76) Inventor: William Ebert, 15 E. Sahuaro, Tucson, AZ (US) 85705

( * ) Notice: Subject to any disclaimer, the term of this patent is extended or adjusted under 35 U.S.C. 154(b) by 0 days.

(21) Appl. No.: 09/527,082

(22) Filed: Mar. 16, 2000

(51) Int. Cl.[7] ..... C25B 9/00

(52) U.S. Cl. ..... 204/279; 204/288; 204/288.1; 204/289

(58) Field of Search ..... 204/279, 288.1, 204/289, 297.01, 288

(56) References Cited

U.S. PATENT DOCUMENTS 4,154,667 * 5/1979 Pohto et al. ..... 204/288
4,338,179 * 7/1982 Dickson et al. ..... 204/288
4,448,664 * 5/1984 Ikegami et al. ..... 204/288
4,824,543 * 4/1989 Peterson et al. ..... 204/288
5,094,735 * 3/1992 Lang, Jr. ..... 204/288
5,762,776 * 6/1998 Alexander et al. ..... 204/279
5,993,620 * 11/1999 Meneghini et al. ..... 204/288

* cited by examiner

*Primary Examiner*—Bruce F. Bell
(74) *Attorney, Agent, or Firm*—Mark E. Ogram P.C.

(57) ABSTRACT

A spacer mechanism which is used to separate electrodes within an electrowinning process. The spacers have a central body portion which defines the distancing between the electrodes and at least four sloping arms extending from the central body. The arms are used to move the electrodes to the top of the central body of the spacer, as the electrodes are being placed next to each other. Each of the arms is ideally narrow so that the "footprint" of the spacer is minimized. The small "footprint" causes minimal disruption of the electrical flow between the electrodes so that the electrodeposition process proceeds in a uniform manner.

15 Claims, 3 Drawing Sheets

SPACER MECHANISM FOR ANODES

BACKGROUND OF THE INVENTION

Priority for this application is claimed from Provisional Patent Application Ser. No. 60/177,791, entitled "Spacer Mechanism for Anodes" filed on Jan. 24, 2000.

This invention relates generally to electro-deposition systems and more particularly to anodes used within such systems.

Electrowinning tanks are used for the extraction of metals from solution by using electrochemical processes. This type of process is commonly used in the extraction of copper onto cathode plates.

Typically, the cathodes and anodes are placed within a slurry containing the sought-after ore. An electrical flow is induced between the anode and the cathode resulting an the ore being deposited onto the cathode. When sufficient deposition has occurred, the cathode is removed and the ore is removed from the cathode.

Spacing between the cathode and anode is critical to assure proper ore deposition. Too narrow of spacing may result in an electrical short occurring; to wide of spacing diminishes the speed of deposition.

To assure proper spacing between the anode and the cathode, a spacer is secured to the bottom of the anode to maintain the desired spacing. This spacer is typically conical shaped to assist in the re-placement of the cathode within the slurry between anodes; that is, the conical shape provides a smooth surface over which the cathode passes when re-inserted into the tank.

Unfortunately, this ideal shape also creates a "vortex" through which the electrical flow swirls. This swirling of the electrical flow can create harmful affects on the cathode as the electrical flow causes the ore to be deposited onto the cathode.

The present invention provides an improved spacer which eliminates this swirling affect.

SUMMARY OF THE INVENTION

The present invention create a spacer mechanism which is used to separate electrodes within an electrowinning process. As noted above, positioning of the electrodes within an electro-deposition or electrowinning process is critical to assure a properly controlled deposition activity.

The spacers have a central body portion which defines the distancing between the electrodes and at least four sloping arms extending from the central body. The shape of the central portion is varied to meet the needs of the particular instance. The central body has a generally circular cross section; although, square cross sectional designs are also contemplated.

To assist with the placement of electrodes during assembly within the electrowinning tanks, the arms are used to move the electrodes to the top of the central body of the spacer. The slope of the arms assures that the electrode as it is lowered, engages one of the sloped arms and is "pushed" away from the electrode having the spacer.

Each of the arms is ideally narrow so that the "footprints" of the spacer is minimized. The preferred embodiment of the invention provides that the width of the arms is less than half the width of the central body.

The small "footprint" causes minimal disruption of the electrical flow between the electrodes so that the electro-deposition process proceeds in a uniform manner. Since the electrical flow is maintained without disruption, variations in the metal deposition is avoided; a generally uniform layer of metal is deposited.

In more detail, the present invention provides for a spacer which has a generally uniform width for its central core. Extending from this center core are alignment wings which assist in aligning the cathode when it is replaced. Each alignment wing has a tapered upper surface for this purpose. In the preferred embodiment, four alignment wings are employed.

In the preferred embodiment, the spacers are manufactured using Injection molding techniques. Compression molding is also employed in some embodiments.

The preferred embodiment is made from acrylic poly vinyl chloride, poly vinyl chloride or vinyl ester which is highly acid resistant and impact resistant to extend its life within the harsh environment in which it is found. This material is also ideal in that should the spacer be broken (partially or wholly), the debris sinks within the tank to avoid jamming of pumps and other equipment within the electro-deposition operation.

The present invention provides for a variety of attributes, including, but not limited to:

1) Ease of Instillation;
2) Compression or injection molded for strength;
3) Material is acid resistant;
4) Material is very impact resistant;
5) Material is non-conductive;
6) The shape makes it easier for electric current to flow around leaving less of a shadow or no shadow on copper cathode;
7) If broken, the spacers sink rather then floating into oven flow and jamming pumps; and,
8) Used to keep anodes and cathodes equal distance from each other to give maximum even current flow for better quality copper and even growth.

The invention, together with various embodiments thereof, will be more fully explained by the accompanying drawings and the following description thereof.

DRAWINGS IN BRIEF

Figure 3:
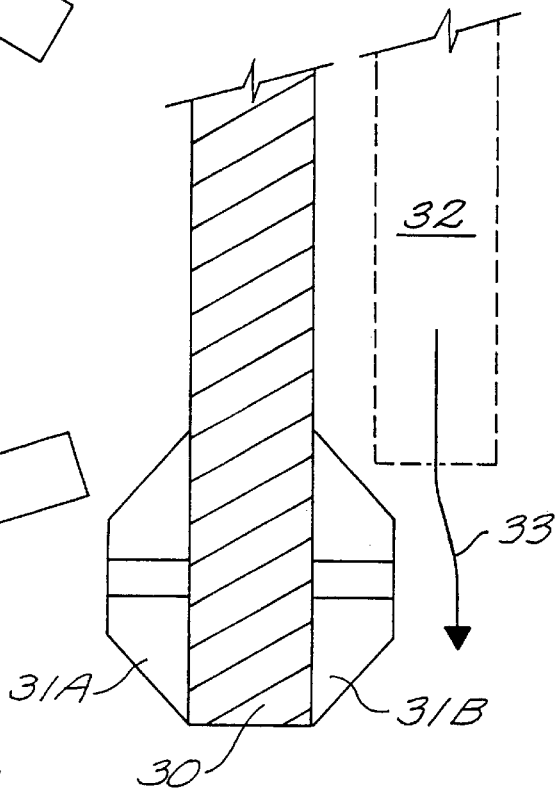

FIG. 3 graphically illustrates the movement of the cathode by the alignment wings as the cathode is placed within the tank.

Figure 4A:
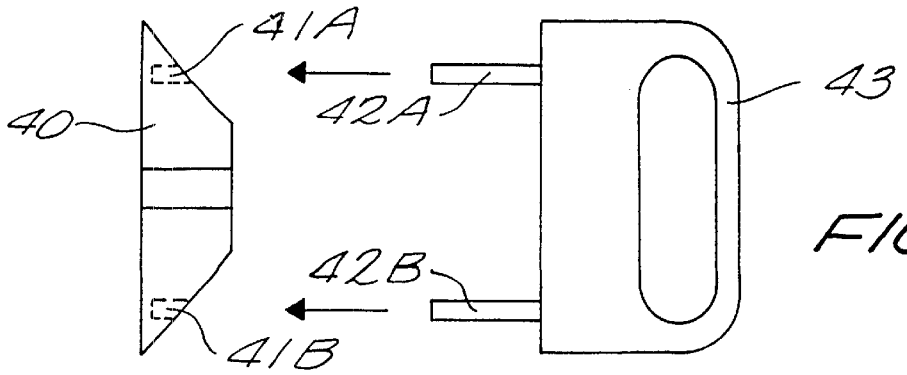
Figure 4B:
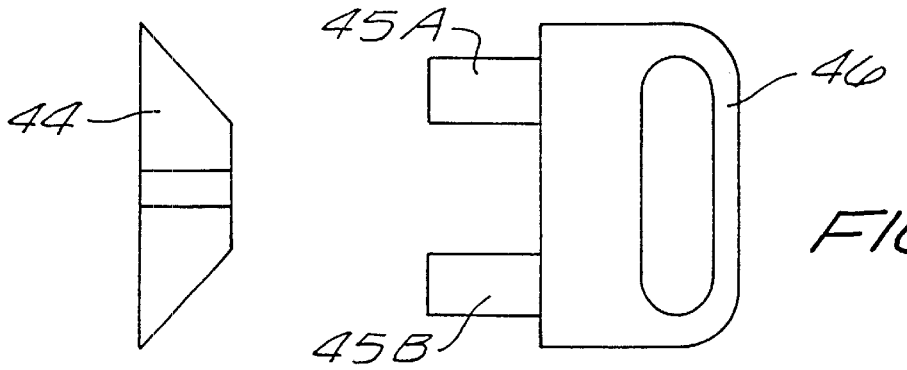

FIGS. 4A and 4B illustrate two different hand tools used to secure spacers to the anode.

Figure 5:
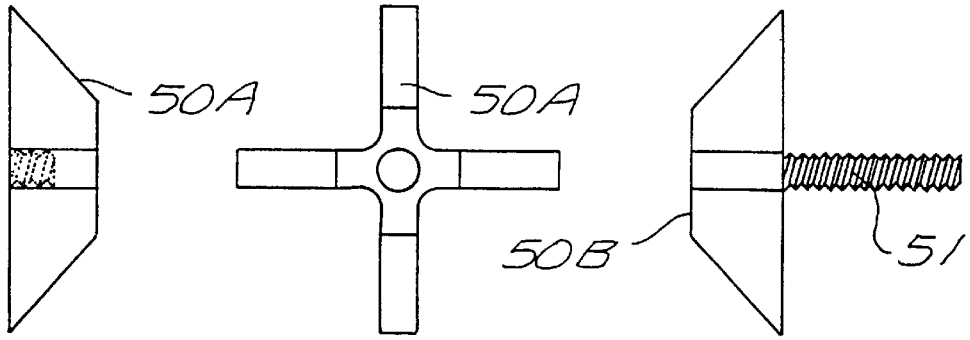

FIG. 5 illustrates an alternative embodiment of the invention.

Figure 6:
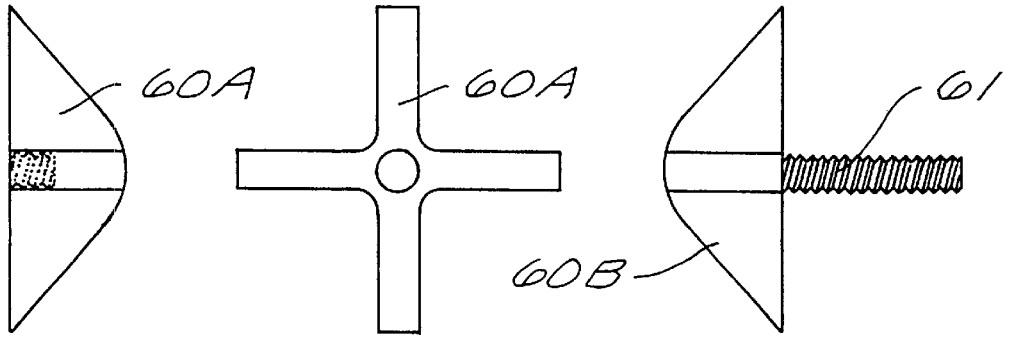

FIG. 6 illustrates yet another alternative embodiment of the invention.

Figure 7:
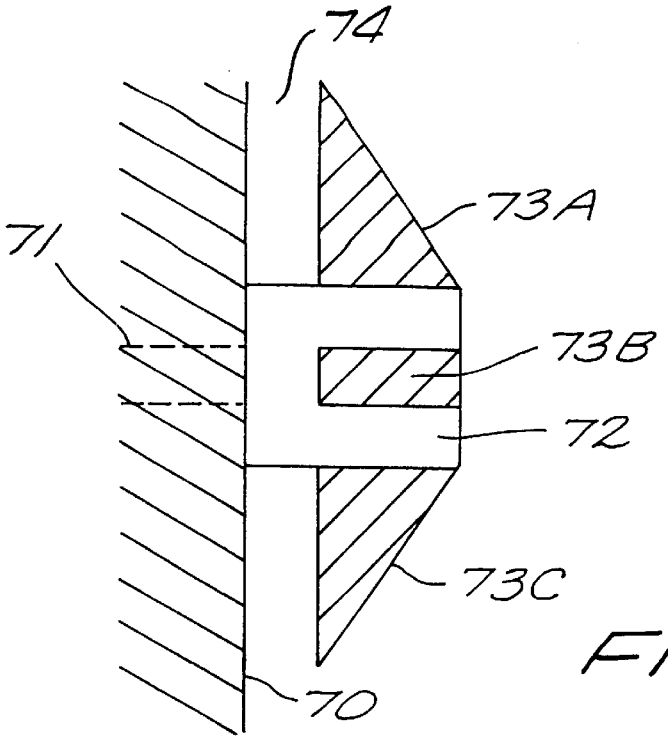

FIG. 7 is a side view of an embodiment of the invention.

Figure 8A:
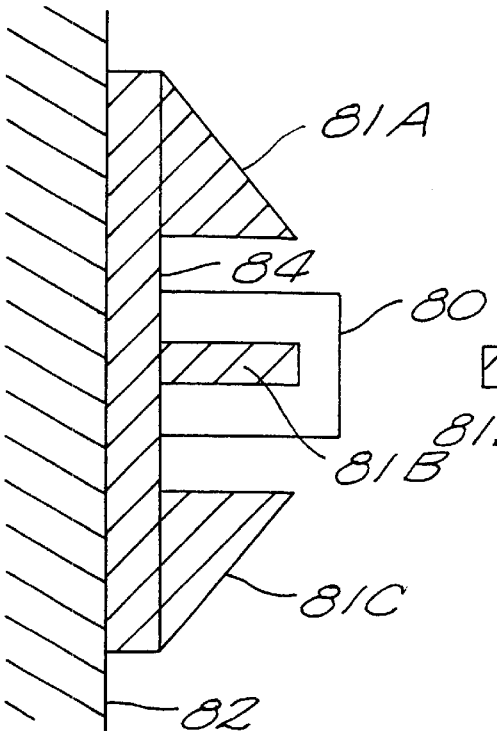
Figure 8B:
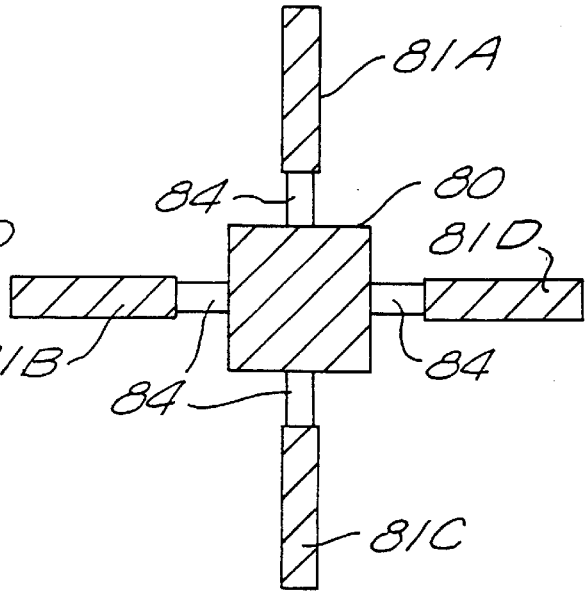

FIGS. 8A and 8B are side and top views respectively of an alternative embodiment of the invention.

DRAWINGS IN DETAIL

Figure 1A:
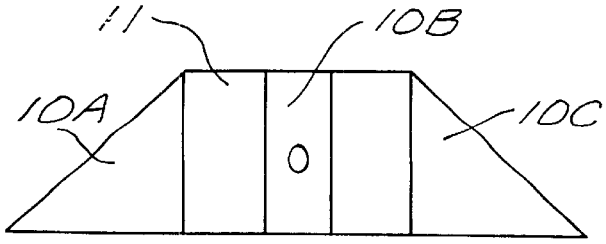
FIGS. 1A and 1B are side and top views of the preferred embodiment of the invention.
Figure 1B:
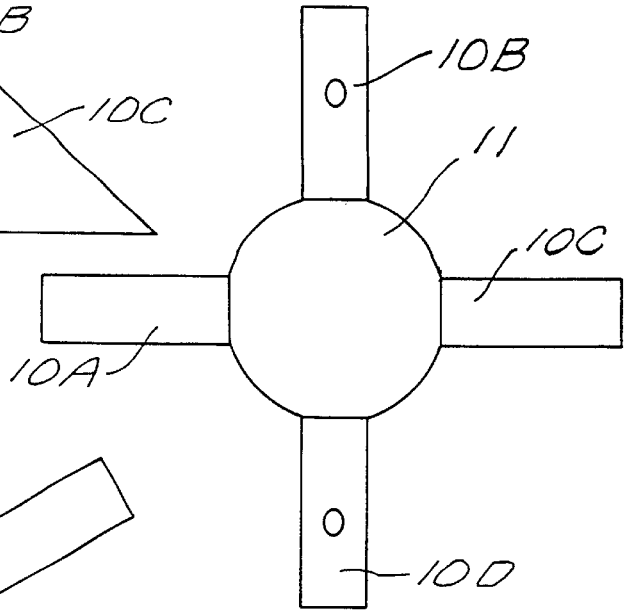

FIGS. 1A and 1B are side and top views of the preferred embodiment of the invention.

Center portion 11 is substantially the same width from its base to the top. Alignment wings 10A, 10B, 10C, and 10D assure that the cathode, as it is being replaced within the electro-winning tank, slide over the top of center portion 11. The height of center portion 11 is chosen to assure the proper distancing between the anode and the cathode.

Figure 2A:
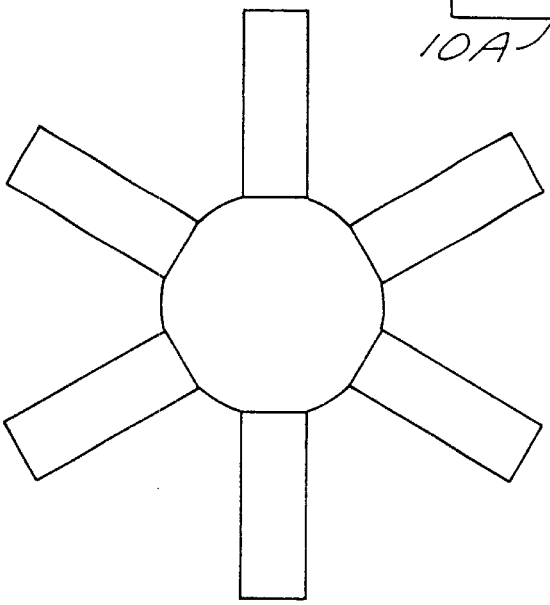
FIG. 2A is a top view and illustrates an alternative embodiment which utilizes six alignment wings.

FIG. 2A is a top view and illustrates an alternative embodiment which utilizes six alignment wings.

Figure 2B:
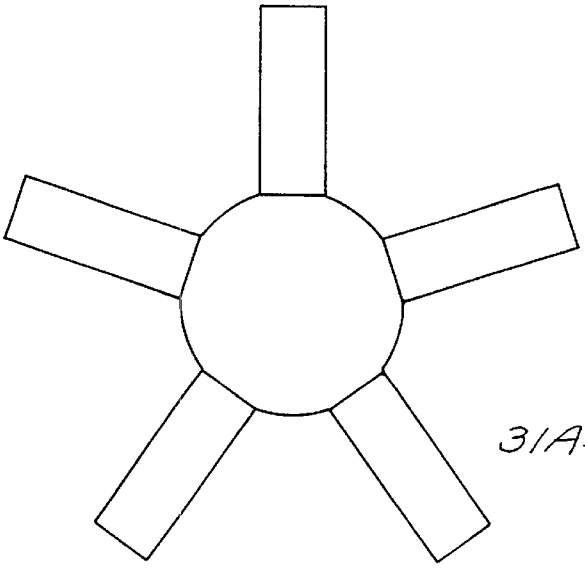
FIG. 2B is a top view and illustrates an alternative embodiment which utilizes five alignment wings.

FIG. 2B is a top view and illustrates an alternative embodiment which utilizes five alignment wings.

While any number of alignment wings is possible, the invention ideally works with at least three alignment wings, and preferably with four alignment wings. Four alignment wings assures that once the spacer is in place, at least one alignment wing is pointing "up" to catch and move the descending cathode as it is re-inserted into the tank next to the anode.

Further, four alignment wings does not create too great of a disturbance to the electrical flow between the anode and the cathode.

FIG. 3 graphically illustrates the movement of the cathode by the alignment wings as the cathode is placed within the tank.

In this illustration, anode 30 has spacers 31A and 31B secured thereto. Spacers 31A and 31B are similar to that shown in FIGS. 1A and 1B.

As cathode 32 is lowered, the bottom of cathode 32 engages with the upper alignment wing of spacer 31B. This upper alignment wing pushes cathode 32 as indicated by arrow 33 so that the distance between anode 30 and cathode 32 is properly established.

FIGS. 4A and 4B illustrate two different hand tools such as a wrench mechanism used to secure spacers to the anode.

In FIG. 4A, spacer 40 is equipped with receiving holes 41A and 41B which are shaped to accept probes 42A and 42B in tool 43. Once properly engaged, the operator is able to turn tool 43 and cause spacer 40 to engage a mating spacer (not shown).

FIG. 4B, uses paddles 45A and 45B from tool 46. Paddles 45A and 45B are shaped to fit around the alignment wings and provide the attachment for rotation of spacer 44 to engage its mating spacer (not shown).

FIG. 5 illustrates an alternative embodiment of the invention illustrating the two matching spacers 50A and 50B. Spacer 50B includes connector 51 which engages with a threaded female opening in the bottom of spacer 50A.

FIG. 6 illustrates yet another alternative embodiment of the invention illustrating the two matching spacers 60A and 60B. Spacer 60B includes connector 61 which engages with a threaded female opening in the bottom of spacer 60A.

FIG. 7 is a side view of an embodiment of the invention.

Extending from a central core 72 are arms 73A, 73B, and 73C (a fourth arm is not visible in this illustration). Each of arms 73A, 73B, and 73C have an upper sloping surfaces which extend to the top of central core 72. As outlined above, these upper sloping surfaces are used to "move" the neighboring electrode as it is lowered into the tank. The height of central core 72 is used to defined the minimal distance between the electrodes.

In this embodiment, arms 73A, 73B, and 73C do not engage the surface of electrode 70, rather a space 74 is created between a base portion of arms 73A, 73B, and 73C, and electrode 70.

Screw mechanism 71 is used to affix the spacer to electrode 70.

FIGS. 8A and 8B are side and top views respectively of an alternative embodiment of the invention.

In this embodiment of the invention, central core 80 has a generally square cross section. Note, the width of arms 81A, 81B, 81C, and 81D are less than half the width of the central core 80.

Arms 81A, 81B, 81C, and 81D are connected to the central core 80 via a base member 84 which maintains the arms (81A, 81B, 81C, and 81D) in a spaced apart relationship to the central core 80.

It is clear that the present invention provides an improved spacer which eliminates this swirling affect.

What is claimed is:

1. A spacer mechanism for electrodes comprising:

a) a central body having a generally uniform cross-section;

b) at least four arms attached to said central body, each of said arms having a sloping surface extending away from a top of said central body; and, c) means for attaching said spacer mechanism to an electrode.

2. The spacer mechanism according to claim 1, wherein, when attached to an electrode, a surface of each of said at least four arms contacts the electrode.

3. The spacer mechanism according to claim 2, wherein two of said at least four arms are configured to be engaged by a wrench mechanism.

4. The spacer mechanism according to claim 3, wherein said two of said at least two arms include receptacles configured to receive two prongs of said wrench mechanism.

5. The spacer mechanism according to claim 2, wherein said central body has a generally circular cross section.

6. The spacer mechanism according to claim 5, wherein a width of the sloping surface of each of the at least four arms is less than the radius of said central body.

7. The spacer mechanism according to claim 2, wherein said central body has a generally square cross section.

8. The spacer mechanism according to claim 7, wherein a width of the sloping surface of each of the at least four arms is less than half the width of said central body.

9. The spacer mechanism according to claim 2, further including a base support connecting said at least four arms to the central body.

10. The spacer mechanism according to claim 1, wherein, when attached to an electrode, none of said at least four arms contact the electrode.

11. An electrode spacer comprising:

a) a central body having at least four arms attached to said central body, each of said arms having a sloping surface extending away from a top of said central body; and, b) means for attaching said spacer mechanism to an electrode.

12. The electrode spacer according to claim 11, wherein, when attached to an electrode, a surface of each of said at least four arms contacts the electrode.

13. The electrode spacer according to claim 12, wherein a width of the sloping surface of each of the at least four arms is less than half a cross section said central body.

14. The electrode spacer according to claim 11, wherein, when attached to an electrode, none of said at least four arms contact the electrode.

15. A kit comprising:

a) a first spacer mechanism for electrodes having, 1) a central body having a generally uniform cross-section, 2) at least four arms attached to said first central body, each of said arms having a sloping surface extending away from a top of said central body, and, 3) a male screw mechanism;

b) a second spacer mechanism for electrodes having, 1) a central body having a generally uniform cross-section, 2) at least four arms attached to said central body, each of said arms having a sloping surface extending away from a top of said second central body, and, 3) a female receptacle adapted to engage the male screw mechanism of the first spacer mechanism; and, c) two wrench mechanisms, each of said wrench mechanisms configured to engage either the first spacer mechanism or the second spacer mechanism.

* * * * *